US005816896A

United States Patent [19]

Schouwenaars

[11] Patent Number: 5,816,896

[45] Date of Patent: Oct. 6, 1998

[54] METHOD AND DEVICE FOR POLISHING GEMSTONES

[75] Inventor: Jozef Schouwenaars, Louvain, Belgium

[73] Assignee: Wetenschappelijk en Technisch Onderzoekscentrum Voor Diamant, Lier, Belgium

[21] Appl. No.: 860,273

[22] PCT Filed: Dec. 1, 1995

[86] PCT No.: PCT/BE95/00112

§ 371 Date: Jun. 17, 1997

§ 102(e) Date: Jun. 17, 1997

[87] PCT Pub. No.: WO96/19318

PCT Pub. Date: Jun. 27, 1996

[30] Foreign Application Priority Data

Dec. 20, 1994 [BE] Belgium ..... 9401143

[51] Int. Cl.[6] ..... B24B 7/22

[52] U.S. Cl. ..... 451/41; 451/5; 451/10; 451/389; 451/386; 451/390

[58] Field of Search ..... 451/41, 5, 9, 10, 451/13, 44, 277, 390, 403, 391, 404, 389, 386, 279

[56] References Cited

U.S. PATENT DOCUMENTS

| | | | |
|---|---|---|---|
| 2,450,984 | 10/1948 | Pastore | 451/389 |
| 3,886,695 | 6/1975 | Elbe | 451/390 |
| 3,902,283 | 9/1975 | Bean | 451/9 |
| 4,955,162 | 9/1990 | Jackson | 451/44 |
| 5,058,324 | 10/1991 | Snellen | 451/403 |
| 5,435,774 | 7/1995 | Naujok | 451/389 |

FOREIGN PATENT DOCUMENTS

| | | |
|---|---|---|
| 0 313 369 | 4/1989 | European Pat. Off. . |
| 0 347 253 | 12/1989 | European Pat. Off. . |
| 31 13 718 | 11/1982 | Germany . |
| 2 249 743 | 5/1992 | United Kingdom . |

*Primary Examiner*—Robert A. Rose
*Assistant Examiner*—George Nguyen
*Attorney, Agent, or Firm*—Browdy and Neimark

[57] ABSTRACT

A method for polishing a gemstone includes providing a polishing surface (11), mounting the gemstone in a holder (6) of a clamp (1), and choosing a reference plane (33) so that it corresponds to the polishing surface. Then the facet polishing depth is set by bringing the gemstone into a position with respect to the reference plane (33) which the gemstone will occupy after completion of polishing the facet. At the moment when the clamp occupies a same position with respect to the polishing surface as the clamp previously occupied with respect to the reference plane, polishing is stopped.

26 Claims, 3 Drawing Sheets

METHOD AND DEVICE FOR POLISHING GEMSTONES

The invention concerns a method for polishing gemstones, in particular diamond, in which a gemstone is mounted in the holder of a clamp and a polishing depth is set in order to obtain a facet, said gemstone being pressed by means of the clamp in the appropriate position against a polishing surface in order to obtain said facet.

In polishing gemstones with high anisotropic hardness such as diamond, a crystal direction is first sought for the polishing in which the least resistance is encountered in grinding away the material. When this direction is known, a first facet of the gemstone is polished. With the existing craft techniques, the polishing operation has to be interrupted at regular intervals in order to check the polishing depth reached and the quality of the facet obtained. This is therefore an iterative process. When a first facet has been polished, the gemstone is rotated by means of rotation axes on the holder, in order to polish a following facet. The angle of rotation is determined with reference to the position of the previously polished facet and the shape which it is wished to obtain for the gemstone.

This has the disadvantage that only a limited accuracy can be achieved, since the absolute position of the gemstone with reference to the polishing disk is not known. This can cause difficulties since the angles between the facets often may not deviate by more than 0.05 degrees.

Whenever grains with a different crystal orientation come to the polishing surface when polishing a facet of a polycrystalline gem, the hardness of the gem in the polishing direction can increase to such an extent that it is necessary to set a new polishing direction. Since the absolute position of the gem with respect to the polishing disk is not known, this gives rise to a laborious process, and usually an unwanted facet is cut. It is also relatively difficult and demands great skill in order to obtain the correct polishing depth for a particular facet.

According to a partially automated technique, in order to accurately determine the polishing depths of the different facets with respect to each other, a metal ring is placed round the gemstone, which is then partially polished, in some cases together with a first facet. When a following facet is polished, this ring makes an electrical contact with the cutting disk when the correct polishing depth has been reached, and the clamp is lifted, as described in UK patents 1 171 211, 1 171 212 and 1 206 937. In some cases this ring is replaced by a stop, which then makes the electrical contact.

This method can however only be employed for polishing gemstones with so-called circular geometry, such as for example a round brilliant. For fancy shapes, however, this is not possible, and at the moment there are no automated methods.

The invention has as its object to overcome these disadvantages by proposing a method which permits a more precise working of the gemstone and makes it possible to polish the gemstone automatically, independently of the desired shape of said gemstone, the accuracy of angle is maintained, irrespective of the set polishing depth and possible corrections made.

To this end, in a first step the gemstone is set in a position with respect to a reference plane, where said position is substantially the same as occupied by the gemstone with respect to said polishing surface when the polishing operation for a facet is finished, said reference plane being chosen such that it corresponds to the polishing surface; next, in a second step, the gemstone is brought opposite the polishing surface, and the polishing operation is carried out until the moment when the clamp occupies the same relative position with respect to the polishing surface as the latter occupies with respect to the reference plane in the first step.

The invention also concerns a specific device for applying this method, with a polishing surface and a clamp, where said clamp is provided with a support block, a head with a holder for removably clamping the gemstone to be polished, and a reference organ for detecting the required polishing depth, said holder is mounted rotatably round an X-axis which is fixed with respect to the head.

This device is characterised by the fact that it comprises an adjustment apparatus which is provided with a means to set said clamp in a position corresponding to that which the clamp occupies with respect to said polishing surface at the moment when polishing a facet of the gemstone has been completed.

Said means can effectively comprise a reference surface located at the same perpendicular distance and position with respect to said support block as the polishing surface when the clamp interacts with said polishing surface and when the required polishing depth of the gemstone has been reached.

Advantageously said reference organ is fixed to said support block.

According to a particular embodiment of the invention, said adjustment apparatus comprises a sensor which interacts with said reference organ.

According to a preferred embodiment of the invention, said support block comprises adjusting organs for setting the clamp in a position, before a facet is polished, such that when a previously determined polishing depth has been reached when polishing said gemstone, the position of the holder is known with respect to the polishing surface at the moment when said facet has been formed.

According to a further embodiment of the invention, said adjustment organ is made such that it enables said head to move with respect to said support block.

Other characteristics and advantages of the invention will be apparent from the following description of a specific embodiment of the method and device for polishing gemstones according to the invention; this description is given only by way of example and in no way limits the scope of the protection claimed; the reference numbers below refer to the attached drawings.

In the different drawings the same reference numbers refer to the same or analogous elements.

Figures 1, 2:
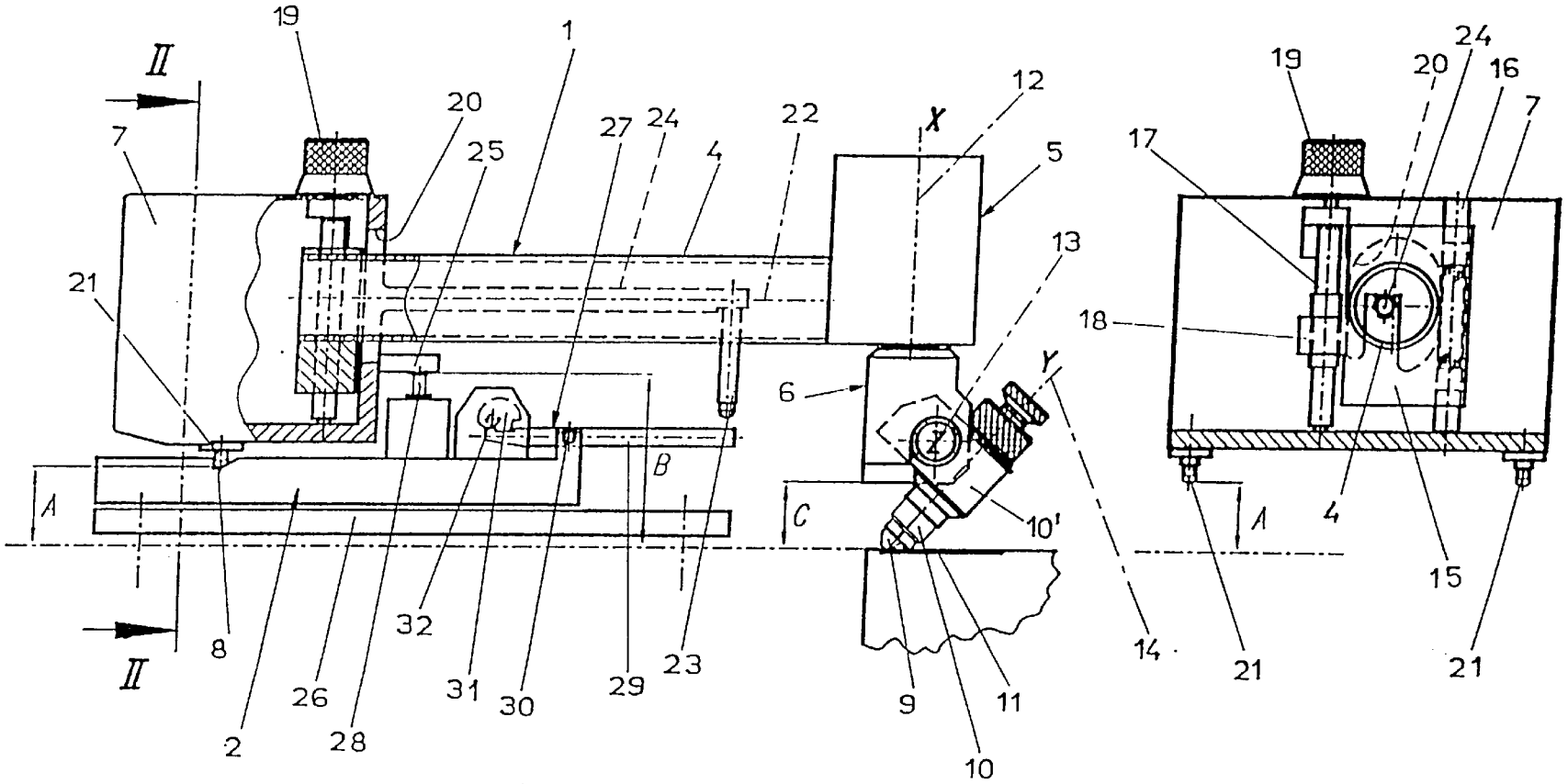
FIG. 1 is a schematic side view, with partial cross-section, of a first component of a specific embodiment of the device according to the invention.
FIG. 2 is a cross-section along line II—II in FIG. 1.
Figure 4:
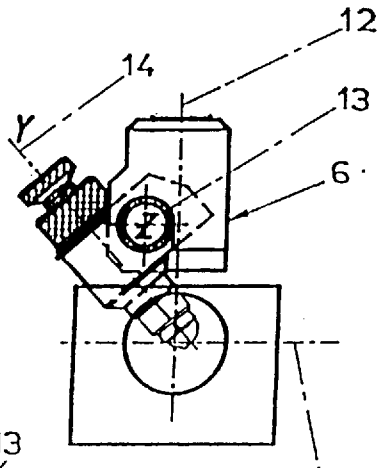
FIG. 4 is a side view of an important component of a clamp according to the invention.

The embodiments of the device shown in the drawings essentially consist of a clamp 1, a slide 2, a polishing disk 11 and an adjustment apparatus 3.

The clamp 1 is provided with an arm 4 which at one end has a head 5 with a holder 6 and at the other end a support block 7. The latter rests freely on two support points 8 of the slide 2 through the intermediary of two supports 21 which project from underneath the support block 7 and are adjustable in height. The supports 21 lie on a straight line which perpendicularly crosses the axis 22 of the arm 4. Accordingly, the clamp 1 can swivel round the straight line connecting the support points 8 in order to hold a gemstone 9 against a polishing disk 11, where said gemstone 9 is removably mounted in an indexing tube 10 mounted in a dop 10' at the other end of the clamp 1.

In order to enable different surfaces or facets to be polished on an gemstone 9, the holder 6 comprising the dop 10' with the indexing tube 10 enables the gemstone 9 to be rotated in different positions with respect to the polishing disk 11. For this purpose the holder 6 has three axes of rotation: an X-axis 12, also named grain shaft, is located at a fixed point with respect to the head 5 and, in the embodiment shown, in a plane perpendicular to said connecting line between the support points 8; a X-axis 13 that intersects the X-axis 12 perpendicularly; and a Y-axis 14 or indexing axis, round which the indexing tube 10 in the dop 10' can turn, where said Y-axis is located in a plane perpendicular to the second axis 13.

The head 5 of the clamp 1 is solidly fixed to the arm 4, which is formed by a relatively stiff tube solidly fixed to a plate 15. Said plate 15 is mounted in the support block 7 such that said plate together with the arm 4 can undergo a translation with respect to the support block 7. For this purpose the plate 15 is led over two parallel bars 16 and 17, as shown in FIG. 2.

In order to precisely adjust the position of the plate 15, one side of said plate is provided with a guide tube 18 which interacts with the corresponding bar 17 which is provided with a screw thread and is rotatable about its axis by means of a turning knob 19. In this way, by turning the knob 19 the plate 15 together with the arm 4 and the head 5 is moved with reference to the support block 7 over the bars 16 and 17. The arm 4 projects out from said support block 7 through an opening 20 which is sufficiently large to permit the movement of the arm 4.

In order to support the clamp 1 or raise it up when tilting, said clamp is provided with a lifting pin 23 which can interact with the slide 2. For this purpose a lifting bar 24 projects along the axis 22 of the arm 4, said lifting bar being fixed at its end to support block 7. The lifting pin 23 is fixed to the other end of said lifting bar 24, such that said lifting pin 23 stands perpendicular to the axis 22 and projects downwards through an opening in the arm 4, past the arm. The lifting bar 24 is executed so that it has less stiffness than the arm 4. This ensures that when the gemstone 9 is brought into contact with the polishing disk 11 during polishing, part of the weight of the clamp 1 is continually supported by the lifting pin 23, so that the gemstone 9 only has to bear a small part of this weight. In this way, when polishing small facets on the gemstone 9, a slight pressure can be applied, making it possible to work with great accuracy.

Further, the support block 7 is provided with a reference organ 25. In the embodiments of the clamp 1 shown in the drawings, according to the invention, the reference organ 25 is formed by a projection solidly attached to the support block 7 on the side opposite the head 5. This reference organ 25 interacts with the slide 2 or the adjustment apparatus 3 and measures the position of the clamp 1.

In FIG. 1, the clamp 1 is shown together with the slide 2. This slide 2 rests on a foot 26 whose height and inclination are adjustable by means of three adjusting screws (not shown), where said foot 26 is placed on a workbench (not shown in this drawing) with a polishing disk 11. This adjustability is necessary when positioning a new polishing disk 11. On the foot 26 are two rails (not shown in the drawing) over which the slide can move back and forth in a radial direction with respect to the polishing disk 11.

The slide 2 is formed by a flat plate on which are the support points 8 for the clamp 1, a lifting mechanism 27 and a sensor 28. Underneath, the slide 2 comprises guides which interact with the rails of the foot 26.

The lifting mechanism 27 is provided with a lever 29 which can tilt round the axis 30. In order to support the clamp 1 by means of the lever 29, the latter extends along one end to underneath the lifting pin 23 in order to interact with said lifting pin 23, so that by letting the lever 29 tilt round the axis 30, the gemstone 9 can be brought towards or away from the polishing disk 11.

The other end of the lever 29 interacts with a cam 31 which is rotatable round an axis 32 which stands perpendicular to the lever 29. Although the lever 29 can be operated manually, the cam 31 is preferably driven by an electric motor (not shown) and, when it rotates, raises or lowers the lever 29.

When polishing small facets, the lever 29 continues to support the lifting pin 23 in order to distribute the weight as explained above, and in order to lift the gemstone away from the polishing disk 11 as quickly as possible as soon as the correct polishing depth has been reached. For polishing larger facets, the lever is set in a position at a shorter distance under the lifting pin 23, in order to lift the gemstone 9 almost instantaneously whenever the polishing depth has been reached.

Further, the slide 2 comprises a sensor 28 which is placed so that when the clamp 1 rests on the slide 2, said sensor 28 is located under the reference organ 25 and can interact with it. In this way a signal is given whenever the reference organ 25 and the sensor 28 make contact. This happens when the clamp 1 tilts round the support points 8 at the moment when a certain polishing depth has been reached for the gemstone 9.

Figure 3:
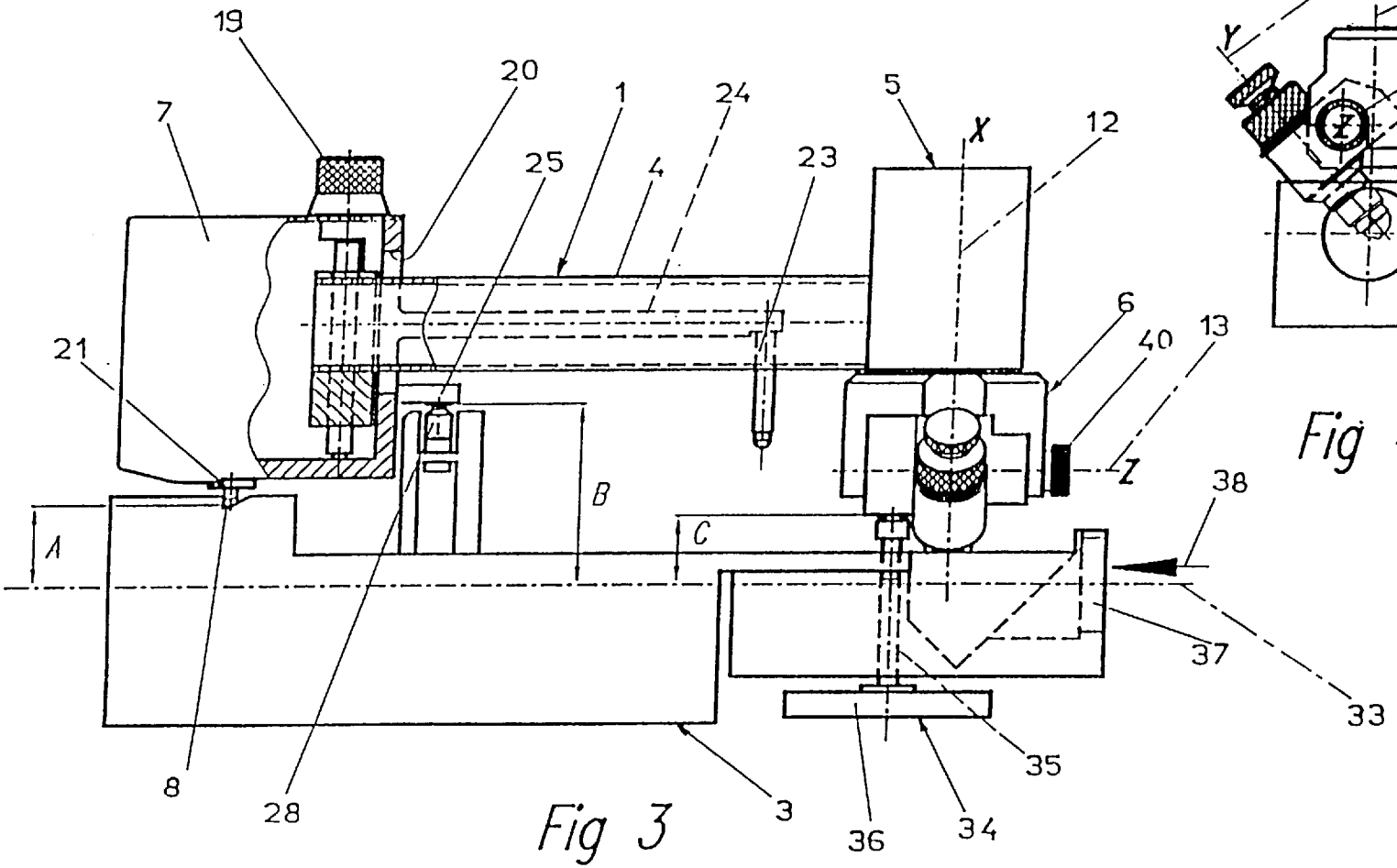
FIG. 3 is a side view, with partial cross-section, of a second component of this specific embodiment of the device according to the invention.

In FIG. 3 the clamp 1 is shown resting on the adjustment apparatus 3. The polishing depth for the gemstone 9 is set by means of this adjustment apparatus 3. This is done working with an imaginary plane or reference plane 33. Said plane 33 corresponds to the surface of the polishing disk 11. Accordingly, the difference in height A between on the one hand the support points 8 belonging to the adjustment apparatus 3, and on the other hand the reference plane 33, is the same as between the support points 8 belonging to the slide 2 and the surface of the polishing disk 11.

Further, the adjustment apparatus 3 comprises a height adjustment organ 34 that supports the holder 6 and can adjust the height of said holder with respect to the reference plane 33. In the embodiment shown, said height adjustment organ 34 comprises a vertical axis 35 with a screw thread, where said axis 35 can be moved up and down by means of a turn screw 36.

On the adjustment apparatus 3, in the neighbourhood of the gemstone 9, is an eyepiece 37 on which the reference plane 33 is indicated. In this way a person looking into the eyepiece 37 in the direction of the arrow 38 will see the gemstone 9 together with the reference plane 33, which corresponds to the polishing surface.

The adjustment apparatus 3 is also provided with a sensor 28 that interacts with the reference organ 25 and occupies the same position with respect to the reference plane 33 as is occupied by the analogous sensor 28 of the slide 2 with respect to the surface of the polishing disk 11. In FIG. 3, reference B indicates the fixed distance, set in advance on the adjustment apparatus 3, between the reference organ 25 and the reference plane 33. This distance is therefore the same as between the reference organ 25 and the polishing disk 11, as shown in FIG. 1.

It is in this position where the distance B is reached that the X-axis of the clamp is calibrated perpendicular to the reference plane and adjusted perpendicular to the polishing disk.

To polish a rough gemstone 9, the gemstone is removably mounted in the dop 10 of the holder 6. The clamp 1 together with the gemstone 9 is then placed on the adjustment apparatus 3. With the help of the height adjustment organ 34 and the eyepiece 37, the clamp 1 is tilted round the support points 8 until the reference plane 33 coincides with an approximation plane for the facet of the gemstone 9 to be polished. In this way, the polishing depth for the gemstone 9 is determined. The fixed axis 12 is then brought perpendicular to the reference plane 33 by making the arm 4 undergo a translation with respect to the support block 7, so that the reference plane 33 coincides with he actual surface of the facet to be polished. This is done with the help of the turn knob 19. The sensor 28 and the reference organ 25 are calibrated so that at the moment when the X-axis 12 is perpendicular to the reference plane 33, said sensor and reference organ make contact with each other and give a signal which for example is processed by means of a computer. This adjusting of the clamp 1 ought nonetheless to be done iteratively.

In a following step, the adjusted clamp 1 is brought to the slide 2. The lever 29 here has to be in the highest position so that the clamp 1 rests on the supports 21 on the one hand, and on the other hand on the lever 29 through the intermediary of the lifting pin 23, such that the gemstone 9 does not touch the polishing disk 11 and the reference organ 25 does not make contact with the sensor 28. Accordingly, the gemstone 9 can be brought into contact with the polishing disk 11 by letting the cam 31 rotate. In order to allow this to happen gradually, even after the first contact with the polishing disk 11, part of the weight of the clamp 1 has to be borne by the lever 29.

During the actual polishing of the gemstone 9, the lever 29 is held at a short distance underneath the lifting pin 23. The clamp 1 descends further during polishing until the reference organ 25 makes contact with the sensor 28. The X-axis 12 is then perpendicular to the surface of the polishing disk 11, and the set polishing depth is then reached. A signal is instantaneously given by the sensor 28 to the electric motor which drives the cam 31, with the result that the gemstone 9 is lifted from the polishing disk 11.

In order to polish a following facet to the gemstone 9, said gemstone is rotated through the desired angle relative to the indexing axis 14. For circular geometries where it is only required to polish one series of facets at the same inclination to the X-axis, it is not necessary to adjust the clamp 1 on the adjustment apparatus again before polishing. For non-circular geometries, the polishing depth has to be set for each facet; this is done to a greater or lesser extent by suitable software.

In order to automate the polishing process, the holder 6 is driven by means of stepper motors, so as to obtain a controlled rotation round the fixed axis or X-axis 12, the Z-axis and the indexing axis 14. In order for the angle of rotation of the holder 6 round the fixed axis 12 to be known, there is an electromagnetic switch ("Hall switch") in the head 5 of the clamp 1, enabling an electrical signal to be generated whenever the holder assumes a particular rotation position. The rotation angle is then calculated on the basis of the number of steps made by the motor. Said motor is located in the support block 7 and is mounted on the plate 15. A drive shaft (not shown in the drawings) extends through the arm 4 into the head 5, where the holder 6 being driven through the intermediary of a transmission and a slip clutch. The slip clutch ensures that the holder 6 can also be rotated mutually about the X-axis 12.

The Z-axis 13 is provided with a turn knob 40 by means of which the assembly formed by the indexing tube 10 and the gemstone 9 can be rotated round the indexing axis 14, in order to set a suitable starting position for polishing.

The rotation movement of the gemstone 9 round the indexing axis 14 is obtained by a stepper motor mounted above the holder 6 in the head 5 of the clamp 1. The movement is transmitted to the gemstone 9 in a conventional manner (not shown) by a shaft, a perpendicular gear transmission and an inclined gear transmission which transmits the movement to a worm shaft. This worm shaft engages a worm wheel that is solidly attached to the indexing tube 10 in which the gemstone 9 is attached. The construction is executed so that the worm shaft coincides with the Z-axis 13.

In order to adjust the rotation angle of the indexing axis 14 round the Z-axis 13, on the holder 6 there is a worm shaft (not shown) with a worm wheel mounted on the dop 10'. The transmission ratios are chosen such that when the worm shaft is turned an angular accuracy of at least 0.1° is possible. The set angle can be read off from a scale (not shown) on the holder 6. This rotation movement can possibly be achieved by means of a stepper motor, which may be mounted in the head 5 or in the support block 7, depending on the mass distribution of the clamp 1.

The bar 17 or turn knob 19 can also be driven by an electric motor; this is advantageous in particular when polishing stones with fancy shapes.

The power for the various electrical stepper motors in the clamp 1 is supplied via the two supports 21, at least one of which is electrically insulated from the support block 7. Accordingly, when the clamp rests on the slide 2, electrical energy can be supplied via said supports 21. When however the clamp 1 is removed from the slide 2, the necessary electrical power is supplied by rechargeable batteries located in the support block 7.

Infrared sensors are build into the underneath of the support block 7, corresponding to sensors lying opposite in the slide. These sensors send data between the slide 2 and the electronic section located in the clamp 1. These data are sent via the slide 2 to a control panel and a computer which coordinates the operation of the various stepper motors and sensors in the clamp 1. If there are several clamps 1 interacting with the same or several polishing disks 11, the computer can coordinate the operation of these various clamps 1.

In a variant of the embodiment described, the reference organ 25 of the clamp 1 and the sensor 28 on the slide 2 and one the adjustment apparatus 3 are replaced by distance sensors (PSDs or position-sensitive detectors), for example those marketed by the Hamatsu company. These distance sensors enable the distance and the variations in distance between the clamp 1 and the slide 2 or setting apparatus 3 to be measured with great accuracy.

This embodiment has important advantages. For example, the polishing speed of the gemstone 9 can be measured, which simplified finding a favourable polishing direction of the gemstone 9.

It is also possible to compensate for any eccentricity of the gemstone 9 with respect to the indexing axis 14, which for example might result from less-than-perfect mounting of the gemstone in the indexing tube 10. To achieve this, the polishing depth for a first facet of the gemstone 9 is set on the adjustment apparatus 3 by means of the height adjustment organ 34 and the turn knob 19. The gemstone 9 is then rotated round the indexing axis 14 into a position corresponding with another facet to be polished that is the most or least eccentric. The polishing depth for this facet is set by means of the height adjustment organ 34. The corresponding distance variation, measured by the distance sensors, is then sent to the computer together with the angular position of the gemstone. This can be done for various positions of the gemstone 9. From these values, the computer calculates the corrections necessary to set the polishing depth for the different facets. When polishing the gemstone 9 the distance variations are measured by the distance sensor, and the gemstone 9 is lifted form the polishing disk 11 whenever the corrected polishing depth has been reached for a particular facet.

During the operation, the gemstone 9 is subject to large temperature differences between one facet and another when polishing, due to the different orientations of the crystal lattices in the different facets. Temperature differences of 300° C. are not uncommon. This can result in a difference of around 50 $\mu$m in the actual polishing depth of one facet with respect to another as a result of thermal expansion. Accordingly, a temperature sensor (thermocouple or radiation thermometer) is preferably mounted in proximity to the gemstone. The values read from this are then converted into corrections for the polishing depth.

During polishing, a pendulum motion is imposed on the slide 2. As a result, the slide 2 moves radially back and forth with respect to the polishing disk, in order to obtain sufficiently polished facets and to obtain even wear on the polishing disk 11. During this oscillating motion the hight variations of the clamp 1 can be measured in order to continually monitor the surface condition of the polishing disk 11. The pendulum motion is driven by means of an electrical stepper motor.

Depending on the gemstone 9 to be polished, different embodiments of the clamp 1 can be used, for example a block clamp, a brillianting clamp or a clamp for fancy shapes. These clamps can be identified by infrared sensors (not shown) underneath the support block 7, so that during setting or polishing, the computer determines which type of clamp is to be controlled, and which setting data from the computer are applicable to this type of clamp. Thanks to calibration of the distances A and B and the perpendicular setting of the X-axis at the calibrated distances, both on the adjustment apparatus and on the different slides, the various polishing clamps are interchangeable, and can be used and exchanged on adjustment apparatuses and slides with the same calibration.

If desired, according to the invention the clamp can simply be used manually, according to the craft method.

The holder 6 of the clamp 1 shown in the drawings further comprises a U-shaped bridge designed so that the position of the indexing axis 14 can vary between 0 and 90 degrees, that is, in principle, between a horizontal and a vertical position.

Figure 5:
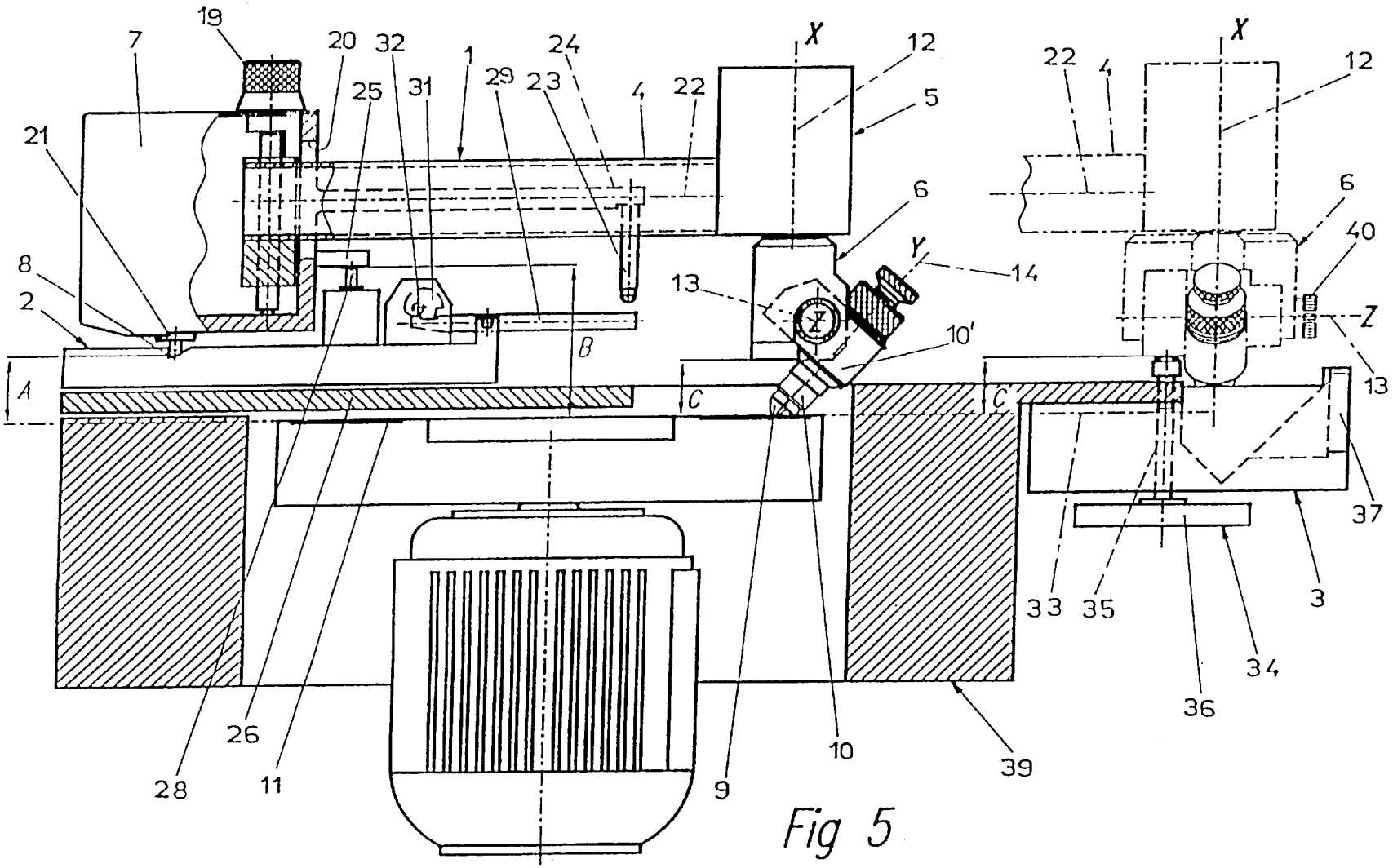
FIG. 5 is a schematic side view of a part of the polishing table, with a slide, an adjustment apparatus and a clamp in partial cross-section, for another embodiment of the device according to the invention.

In a more compact embodiment of the device according to the invention, as shown in FIG. 5, the adjustment apparatus 3 and the foot 26 of the slide 2 are incorporated in a polishing table 39. In this way, by moving the slide 2 over the foot 26 it is possible to let the holder 6 of the clamp 1 rest on the height adjusting organ 34 of the adjustment apparatus 3. Accordingly, no extra sensor 28 is necessary on the adjustment apparatus 3. In this compact embodiment the polishing disk 11 preferably has a diameter of 200 mm instead of the 320 mm normally used in the other embodiment. Such an embodiment can be used for polishing girdles. These are mostly polished using smaller polishing disks which rotate about a horizontal axis.

The form of the clamp 1 in the different embodiments is chosen such that it is easy to use manually and differs only slightly from the known, conventional form.

The invention is of course in no way limited to the proposed embodiments of the device according to the invention as described above and shown in the drawings. For example, a clamp can be used in which the support block can be mounted on a fixed column on which it can be moved up and down. In this specific case, the above-mentioned slide can if necessary be left out, and any sensor 28 present is mounted directly on a fixed foot 26. The slide can also be dispensed with in some cases when the support block tilts around a support. Further, it is possible for the head 5 to be moved with respect to the arm 4, which is then solidly connected to the support block.

By means of the stepper motors and the various sensors, an almost unlimited number of restrictions can be imposed on the device according to the invention, by using a computer with appropriate software, which can vary according to the geometry of the clamp and the geometry of the gemstone to be polished. In this way the most diverse polishing shapes can be obtained. All movements can be carried out either manually or with the help of a motor. The eyepiece 37 can possibly be replaced by a camera which can also function as a measurement system. The sensor 28 can also be used for lining up the foot 26.

I claim:

1. A device for polishing a facet on a gemstone (9), such as a diamond, with a polishing surface (11) and a clamp (1) provided with a support block (7), a head (5) with a holder (6) for removably clamping the gemstone (9) to be polished, and a reference means (25) for detecting the required polishing depth, where said holder (6) is rotatably mounted around an X-axis (12) which is fixed with respect to the head (5), which device being improved in that it comprises an adjustment apparatus (3) provided with positioning means (33, 34, 37) for setting said clamp (1) in a position corresponding to that which said clamp occupies with respect to said polishing surface at the moment when polishing of a facet of the gemstone (9) is completed.

2. A device according to claim 1, wherein said positioning means comprise a reference plane (33) that is located at a distance (A) relative to support points (8) around which the support block is tiltable, the distance being the same as a distance between the polishing surface (11) and the support points (8) at moment that the required polishing depth of the gemstone is reached.

3. A device according to claim 1, wherein said reference means (25) is fixed to said support block (7).

4. A device according to claim 1, wherein said adjustment apparatus (3) comprises a sensor (28) which interacts with said reference means (25).

5. A device according to claim 1, wherein said support block (7) comprises adjusting means (17, 18, 19) for adjustably setting the clamp (1) by translating the head (5) with respect to the support block (7).

6. A device according to claim 5, wherein said adjusting means are executed so that they permit said head (5) to be subjected to an up-and-down translation with respect to said support block (7).

7. A device according to claim 1, wherein said adjusting means (17, 19) are driven by an electric motor.

8. A device according to claim 1, wherein said head (5) is solidly attached to an arm (4) which extends between said head (5) and the support block (7).

9. A device according to claim 1, wherein said reference means (25) interacts with a sensor (28) to determine the position of the clamp (1) with respect to the polishing surface (11).

10. A device according to claim 1, wherein said support block (7) is provided with at least one support (21) which rests on a support point (8) round which the clamp (1) is tiltable.

11. A device according to claim 10, wherein said clamp (1) is provided with a lifting pin (23) in order to support it when tilting round said support point (8), at least at the beginning of contact between the gemstone and the polishing surface (11) and when the contact is ended.

12. A device according to claim 11, wherein said lifting pin (23) is attached to a lifting bar (24) which extends according to said arm (4) and is fixed to said supporting block (7).

13. A device according to claim 12, wherein said lifting bar (24) has a lower degree of stiffness than said arm (4).

14. A device according to claim 10, wherein it comprises a slide (2) on which the clamp (1) rests on the support point (8) through the intermediary of said support (21).

15. A device according to claim 14, wherein said slide (2) is provided with a lifting mechanism (27) for said clamp (1).

16. A device according to claim 15, wherein said lifting mechanism (27) comprises a lever (29) which at one end interacts with a driven cam (31) and at the other end with said lifting pin (23).

17. A device according to claim 14, wherein said sensor (28) is provided on the slide (2) in order to determine the position of the clamp (1) with respect to the latter.

18. A device according to claim 17, wherein said reference means (25) contacts said sensor (28) to determine when the desired polishing depth has been reached, said X-axis (12), fixed with respect to the head (5), being perpendicular to the polishing surface.

19. A device according to claim 14, wherein said slide (2) is movable radially with respect to the polishing disk (11).

20. A device according to claim 1, wherein said holder (6) comprises two axes of rotation (13, 14), which are preferably perpendicular to each other, so that a gemstone (9) mounted in the holder (6) is rotatable around each of the axes (13, 14) of the holder (6).

21. A device according to claim 20, wherein said two axes of rotation are perpendicular to said X-axis (12), and further comprise a rotation axis (13) and an indexing axis (14) perpendicular to the rotation axis (13).

22. A device according to claim 20, wherein at least one of said axes (12, 13, 14) for rotating the gemstone (9) into a particular position is driven by an electric motor.

23. A device according to claim 22, wherein said holder (6) is driven around said fixed axis (12) by a stepper motor, possibly with a slip clutch being provided between the holder (6) and said motor in order to enable a manual rotation of the holder (6) round said axis (12), and where a detector is provided on the holder (6) which receives a signal once per revolution in order to determine the exact position of the holder (6) with respect to said axis (12).

24. A device according to claim 23, wherein said detector is a magnetic switch.

25. A method for polishing a gemstone, comprising:

providing a polishing surface (11);

mounting the gemstone in a holder (6) of a clamp (1);

choosing a reference plane (33) so that it corresponds to the polishing surface;

setting a facet polishing depth, including bringing the gemstone into a position with respect to the reference plane (33) which the gemstone will occupy after a completion of polishing the facet onto the gemstone; and polishing the gemstone on the polishing surface until a moment when the clamp occupies a same position with respect to the polishing surface as the clamp previously occupied with respect to the reference plane.

26. The method according to claim 25, including:

providing an X-axis around which the holder is rotatable relative to the clamp;

wherein the step of bringing the gemstone into a position includes bringing the X-axis perpendicular to the reference plane; and wherein the step of polishing includes polishing until a moment when the X-axis stands perpendicular to the polishing surface.

* * * * *